US005700387A

United States Patent [19]

Haq et al.

[11] Patent Number: 5,700,387

[45] Date of Patent: Dec. 23, 1997

[54] FABRIC SOFTENING COMPOSITION

[75] Inventors: Ziya Haq, Wirral; Abid Nadim Khan-Lodhi, Chester; Philip John Sams, South Wirral, all of United Kingdom

[73] Assignee: Lever Brothers Company, Division of Conopco, Inc., New York, N.Y.

[21] Appl. No.: 418,043

[22] Filed: Apr. 6, 1995

[30] Foreign Application Priority Data

Apr. 7, 1994 [GB] United Kingdom ..... 9406824

[51] Int. Cl.[6] ..... B01F 3/00

[52] U.S. Cl. ..... 252/8.63; 510/520; 252/363.5

[58] Field of Search ..... 428/286, 288, 428/245; 252/8.6, 8.7, 8.8, 8.75, 8.9, 8.63, 363.5; 510/520

[56] References Cited

U.S. PATENT DOCUMENTS

| | | | |
|---|---|---|---|
| 3,892,669 | 7/1975 | Rapisarda et al. | 252/8.75 |
| 4,049,858 | 9/1977 | Murphy | 428/136 |
| 4,137,180 | 1/1979 | Nalk et al. | 252/8.8 |
| 4,238,531 | 12/1980 | Rudy | 427/242 |
| 4,304,562 | 12/1981 | Bolan | 8/137 |
| 4,327,133 | 4/1982 | Rapisarda | 427/242 |
| 4,789,491 | 12/1988 | Chang | 252/8.75 |
| 4,950,412 | 8/1990 | Duffin et al. | 252/8.6 |
| 5,062,973 | 11/1991 | Kellett | 252/8.75 |
| 5,066,413 | 11/1991 | Kellett | 252/8.8 |
| 5,126,060 | 6/1992 | Puentes-Bravo et al. | 252/8.6 |
| 5,300,238 | 4/1994 | Lin et al. | 252/8.6 |
| 5,474,691 | 12/1995 | Severns | 252/8.9 |
| 5,480,567 | 1/1996 | Lam et al. | 252/8.8 |

FOREIGN PATENT DOCUMENTS

| | | |
|---|---|---|
| 1 005 204 | 8/1993 | Canada . |
| 002 857 | 7/1979 | European Pat. Off. . |
| 013 780 | 8/1980 | European Pat. Off. . |
| 040 562 | 11/1981 | European Pat. Off. . |
| 054 493 | 6/1982 | European Pat. Off. . |
| 079 746 | 5/1983 | European Pat. Off. . |
| 111 074 | 6/1984 | European Pat. Off. . |
| 125 031 | 11/1984 | European Pat. Off. . |
| 157 618 | 10/1985 | European Pat. Off. . |
| 238 638 | 6/1987 | European Pat. Off. . |
| 239 910 | 10/1987 | European Pat. Off. . |
| 199 765 | 3/1988 | European Pat. Off. . |
| 326 213 | 8/1989 | European Pat. Off. . |
| 361 593 | 4/1990 | European Pat. Off. . |
| 392 607 | 10/1990 | European Pat. Off. . |
| 404 471 | 12/1990 | European Pat. Off. . |
| 507 478 | 10/1992 | European Pat. Off. . |
| 532 488 | 3/1993 | European Pat. Off. . |
| 569 184 | 4/1993 | European Pat. Off. . |
| 547 723 | 6/1993 | European Pat. Off. . |
| 568 297 | 11/1993 | European Pat. Off. . |
| 569 847 | 11/1993 | European Pat. Off. . |
| 354 011 | 8/1995 | European Pat. Off. . |
| 1447334 | 6/1965 | France . |
| 2163771 | 9/1985 | United Kingdom . |
| 92/06161 | 4/1992 | WIPO . |
| 92/18593 | 10/1992 | WIPO . |
| 94/02676 | 7/1993 | WIPO . |
| 93/18125 | 9/1993 | WIPO . |
| 93/23510 | 11/1993 | WIPO . |
| 94/17169 | 8/1994 | WIPO . |
| 95/13346 | 5/1995 | WIPO . |

OTHER PUBLICATIONS

PCT Search Report dated Aug. 21, 1995.

PCT Search Report dated Jul. 6, 1995.

R. G. Laughlin, "Surfactant Science Series 2", vol. 37 (Cationic Surfactants Physical Properties, pp. 449–465, Marcel Decker, Inc. 1991.

D. Marsh, CRC Press, Boca Raton, Florida, 1990, "Handbook of Lipid Bilayers", pp. 137 and 337.

G.J.T. Tiddy et al., *J. Chem. Soc. Faraday Trans.* 1., vol. 79, p. 975, (1983).

*Primary Examiner*—James J. Bell

*Attorney, Agent, or Firm*—Matthew Boxer

[57] ABSTRACT

Patent application that covers the concept of a conditioner sheet coated with a solubilised rinse conditioners comprising a fabric softening compound and a solubilising agent. The dryer sheets softens at low temperatures and is non-staining. The invention works particularly well with HEQ.

12 Claims, No Drawings

FABRIC SOFTENING COMPOSITION

TECHNICAL FIELD

The present invention relates to fabric softening compositions. In particular the invention relates to fabric softening compositions which are to be coated on a substrate and used to soften fabrics in a tumble dryer.

BACKGROUND AND PRIOR ART

It is known that fabrics can be softened in a tumble dryer by co-mingling fabrics with a flexible substrate carrying a normally solid fabric-conditioning agent. This process is described in CA 1 005 204 (Procter and Gamble).

Dryer sheets soften fabrics by direct transfer of molten softening compound, as taught by the review by R. G. Laughlin in "Surfactant Science Series 2 Volume 37 Cationic surfactants Physical Properties Pages 449 to 465. (Marcel Decker, inc, 1991).

There are disadvantages with conventional dryer sheets. Fabric conditioner does not transfer until the melting point of the solid fabric-conditioning agent is reached (as temperature in the machine rises), if the fabric is taken out while still damp, or if a low-temperature cycle is used, it is not softened. Furthermore, when co-mingling fabrics with impregnated substrates there is a risk that the conditioner may not be evenly distributed and staining may occur. A further disadvantage is that a distribution agent is generally needed to aid spreading of the fabric softening compound on the fabrics, however a distribution aid can lead to the dryer sheet feeling tacky. To overcome the tacky feel due to the spreading aid a structuring agent can be used, however this increases the cost of the dryer sheet.

The problem of fabric staining by dryer sheets is tackled by U.S. Pat. No. 5,066,413 (Kellett) which claims a non-staining dryer sheet comprising a water-miscible organic solvent and an alkali metal stearate. An alternative approach to reducing staining of laundry is taken by U.S. Pat. No. 4,049,858 (Procter and Gamble) which discloses a fabric softener for automatic clothes dryers containing a sorbitan ester softener and fatty acid soap phase modifier.

U.S. Pat. No. 4,238,531 (Rapisarda) and U.S. Pat. No. 4,327,133 (Rapisarda) disclose a dryer sheet comprises a fabric softening agent and a distribution agent. The distribution agent are said to improve the uniformity of the distribution of the fabric softening agent.

EP 532 488 (Unilever) discloses a dryer sheet which is coated with a formulation comprising compatible organosilicones. The organosilicones are said to enhance the spreading of the fabric softening agents on the fabric surface. U.S. Pat. No. 4,767,548 (Kasprzak) discloses the use of certain silicones in dryer sheet formulations.

EP 54 493 (Unilever) discloses a fabric softening composition containing a softening compound and a emulsified silicone mixture of specific structure. The composition is said to limit the tacky feel associated with sheets and aid even coating of the composition on the sheet.

A composition for coating dryer sheets is disclosed in EP 392 607 (Procter and Gamble). The composition contains a fabric softener, a perfume/cyclodextrin complex and a clay viscosity control agent.

We have surprisingly found a novel fabric softening composition for coating/impregnating a substrate which avoids the disadvantages of the prior art yet can be made without the need of separate distribution aids or structuring agents. The substrate of the invention softens the laundry in the dryer at low temperatures, is non-staining and gives even deposition onto the laundry.

DEFINITION OF THE INVENTION

Thus according to one aspect of the invention there is provided a fabric softening composition for coating or impregnating a substrate comprising:

i) a substantially water insoluble fabric softening compound comprising a head group and two alkyl or alkenyl chains each having an average chain length greater than or equal to $C_{14}$ or a single alkyl or alkenyl chain with an average chain length greater than or equal to $C_{20}$; and ii) a solubilising agent comprising a nonionic or amphoteric surfactant or mixture thereof and optionally a non-surfactant cosolubiliser;

characterised in that when the fabric softening composition is diluted in water to a concentration of 5 wt % of i and ii, at least 70 wt % of the fabric softening compound is in solution.

A further aspect of the invention provides the use of self-size-limiting molecular aggregates as a fabric softening composition for coating or impregnating a substrate.

DETAILED DESCRIPTION OF THE INVENTION

Without wishing to be bound by theory it is believed that the fabric conditioner of the invention does not function in the conventional way, transferring only in the molten state, and when contacted with water may be solubilised partially in the form of self-size-limiting molecular aggregates such as micelles or micellar structures with solid or liquid interiors or mixtures thereof. It is thought that it is this new transfer mechanism that overcomes the problems of the prior art.

Suitably, the fabric softening compound and solubilising agent form a transparent mix.

The following tests may be used to determine whether or not a composition falls within the present invention.

Test I a) The fabric softening composition (not yet coated on the sheet) is diluted with water to a concentration of 5 wt % (of the fabric softening compound and the solubilising agent i.e. the nonionic surfactant and any non-surfactant cosolubiliser). The diluate is warmed to between 60°–80° C. then cooled to room temperature and stirred for 1 hour to ensure equilibration. A first portion of the resulting test liquor is taken and any material which is not soluble in the aqueous phase is separated by sedimentation or filtration until a clear aqueous layer is obtained. (Ultaracentrifuges or ultrafilters can be used for this task.) The filtration may be performed using a succession of membrane filters of 1 μm, 0.45 μm and 0.2 μm.

b) The concentration of the fabric softening compound in the clear layer is measured by titrating with standard anionic surfactant (sodium dodecyl sulphate) using dimidiumsulphide disulphine blue indicator in a two-phase titration with chloroform as extracting solvent.

c) The titration with anionic surfactant is repeated with a second portion of fabric softening composition which has been diluted but not separated.

d) Comparison of b) with c) should show that the concentration of fabric softening compound in b) is at least 70 wt % (preferably 80 wt %) of the concentration of fabric softening compound in c). This demonstrates that the fabric softening compound was in solution.

The Test I procedure is suitable for compositions in which the fabric conditioner is cationic (or becomes cationic on dilution). The following test is also suitable for non-cationic compositions.

Test II a) The fabric softening composition is diluted as for Test I.

b) The viscosity of the diluate at a shear rate of 110s-1 is measured.

c) The diluate is warmed to 60° C. and held at this temperature for 1 day.

d) The diluate, with gentle stirring, is cooled to 20° C. and the viscosity is once again measured at a shear rate of 110s-1.

e) Comparison between the viscosities of b) and c) should show that they differ by less than 5 mPas.

Test III

A dryer sheet coated with the composition according to the invention is sandwiched between two pieces of terry towelling (pre-soaked so they each contain 100 g of water (190×190 mm 14 g). The towelling is in turn sandwiched between two ceramic tiles. The tiles are placed horizontally and a 1 kg weight is placed on the uppermost tile. After 15 or 30 minutes the towelling is removed and line dried. Staining of the towelling with bromophenol blue indicator was used to indicate that the towelling was coated with cationic fabric softening compound.

As for test I this test is only suitable with fabric softening compositions containing a cationic softening compound.

It is preferable if the fabric softening of the invention conforms to the following test:

Test IV a) The fabric softening composition is diluted as for test I.

b) The viscosity of the diluate at a shear rate of 110s-1 is measured.

c) The diluate is frozen and thawed.

d) The viscosity is once again measured at a shear rate of 110s-1.

e) Comparison between the viscosities of b) and c) should show they differ by less than 10 mPas.

The Fabric Softening Compound

The fabric softening compound is suitably a substantially water insoluble quaternary ammonium material comprising a single alkyl or alkenyl long chain having an average chain length greater than or equal to $C_{20}$ or, more preferably, a compound comprising a polar head group and two alkyl or alkenyl chains each having an average chain length greater than or equal to $C_{14}$.

Preferably the fabric softening compound of the invention has two long chain alkyl or alkenyl chains, each having an average chain length greater than or equal to $C_{16}$. Most preferably at least 50% of each long chain alkyl or alkenyl group has a chain length of $C_{18}$.

It is preferred if the long chain alkyl or alkenyl groups of the fabric softening compound are predominantly linear.

The fabric softening compounds used in the compositions of the invention are molecules which provide excellent softening, and characterised by a chain melting —Lβ to Lα— transition temperature greater than 25° C., preferably greater than 35° C., most preferably greater than 45° C. This Lβ to Lα transition can be measured by DSC as defined in "Handbook of Lipid Bilayers, D Marsh, CRC Press, Boca Raton Fla., 1990 (Pages 137 and 337).

Substantially insoluble fabric softening compounds in the context of this invention are defined as fabric softening compounds having a solubility less than $1\times10^{-3}$ wt % in demineralised water at 20° C. Preferably the fabric softening compounds have a solubility less than $1\times10^{-4}$. Most preferably the fabric softening compounds have a solubility at 20° C. in demineralised water from $1\times10^{-8}$ to $1\times10^{-6}$.

Preferred fabric softening compounds are quaternary ammonium compounds.

It is especially preferred if the fabric softening compound is a water insoluble quaternary ammonium material which comprises a compound having two $C_{12-18}$ alkyl or alkenyl groups connected to the molecule via at least one ester link. It is more preferred if the quaternary ammonium material has two ester links present. An especially preferred ester-linked quaternary ammonium material for use in the invention can be represented by the formula:

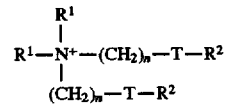

wherein each $R^1$ group is independently selected from $C_{1-4}$ alkyl, hydroxyalkyl or $C_{2-4}$ alkenyl groups; and wherein each $R^2$ group is independently selected from $C_{8-28}$ alkyl or alkenyl groups;

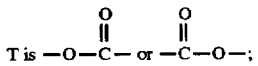

and n is an integer from 0–5.

Di(tallowyloxyethyl) dimethyl ammonium chloride is especially preferred.

A second preferred type of quaternary ammonium material can be represented by the formula:

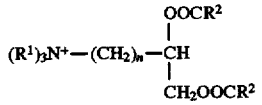

wherein $R^1$, n and $R^2$ are as defined above.

It is advantageous for environmental reasons if the quaternary ammonium material is biologically degradable.

Preferred materials of this class such as 1,2 bis[hardened tallowoyloxy]-3- trimethylammonium propane chloride and their method of preparation are, for example, described in U.S. Pat. No. 4,137,180 (Lever Brothers). Preferably these materials comprise small amounts of the corresponding monoester as described in U.S. Pat. No. 4,137,180 for example 1-hardened tallowoyloxy-2-hydroxy-3-trimethylammonium propane chloride.

Lecethins are also suitable softening compounds.

The Solubilising Agent

The solubilising agent is a nonionic or an amphoteric surfactant, and is characterised in terms of its phase behaviour. Suitable solubilising agents are nonionic or amphoteric surfactants for which, when contacted with water, the first lyotropic liquid crystalline phase formed is normal cubic (I1) or normal cubic-bicontinuous (V1) or hexagonal (H1) or nematic (Ne1), or intermediate (Int1) phaseas defined in the article by G J T Tiddy et al, J Chem Soc. Faraday Trans. 1., 79, 975, 1983 and G J T Tiddy, "Modern Trends of Colloid Science in Chemistry and Biology", Ed. H-F Eicke, 1985

Birkhauser Verlag Basel]. Surfactants forming Lα phases are not suitable at concentrations of less than 20 wt %.

For the purposes of this invention nonionic surfactants may be defined as substances with molecular structures consisting of a hydrophilic and hydrophobic part. The hydrophobic part consists of a hydrocarbon and the hydrophilic part of strongly polar groups.

The most preferred nonionic surfactants are ethoxylated compounds and carbohydrate compounds. Where the composition is in solid form, for example a powder, the nonionic surfactant is desirably a carbohydrate compound or derived from a carbohydrate compound.

Examples of suitable ethoxylated compounds include ethoxylated alcohols, alkyl phenols, fatty acids, fatty amines, esters and sorbitan esters.

Preferred nonionic ethoxylated surfactants have an HLB of from about 10 to about 20. It is advantageous if the surfactant alkyl group contains at least 12 carbon atoms. It is further preferred if the nonionic softening compounds have from 10 to 30 ethoxylate groups, preferably from 10 to 20 ethoxylate groups.

Examples of suitable carbohydrate surfactants or other polyhydroxy surfactants include alkyl polyglycosides as disclosed in EP 199 765 (Henkel) and EP 238 638 (Henkel), poly hydroxy amides as disclosed in WO 93 18125 (Procter and Gamble) and WO 92/06161 (Procter and Gamble), fatty acid sugar ester (sucrose esters), sorbitan ester ethoxylates and poly glycerol esters.

Mixtures of solubilising agent may be used. For compositions in solid form, especially powder, the solubilising agent is desirably solid at room temperature as this provides crisp composition particles.

Excellent softening is achieved if mixtures of carbohydrate based nonionic surfactants and long chain ethoxylate based nonionic surfactants are used. Preferably the ratio of carbohydrate compounds to long chain alcohol ethoxylate is from 3:1 to 1:3, more preferably from 1:2 to 2:1, most preferably approximately 1:1.

Alternatively the solubilising agent may be amphoteric. In the context of this invention amphoteric surfactants are defined as substances with molecular structures consisting of a hydrophillic and hydrophobic part. The hydrophobic part consists of a hydrocarbon and the hydrophillic part consists of both a positive and a negative group. Preferred amphoteric surfactants include amine oxides, sulphobetaines, phosphine oxides and sulphoxides.

It is preferable if the solubilising agent is solid at room temperature.

It is particularly advantageous if the solubilising agent further comprises a non-surfactant co-solubiliser. Preferred co-solubilisers include propylene glycol, urea, acid amides up to and including chain lengths of $C_6$, citric acid and other poly carboxylic acids as disclosed in EP 0 404 471 (Unilever), glycerol, sorbitol and sucrose. Particularly preferred are polyethylene glycols (PEG) having a molecular weight ranging from 200–6000, most preferably from 1000 to 2000.

It is advantageous if the weight ratio of solubilising agent (where relevant this would also include the co-solubiliser) to fabric softening compound is greater than 1:6, preferably greater than 1:4, more preferably equal to or greater than 2:3. It is advantageous if the ratio of solubilising agent to fabric softening compound is equal to or below 4:1, more preferably below 3:2.

It is preferred if the ratio of co-solubiliser to nonionic surfactant is from to 2:1 to 1:40, preferably the ratio of co-solubiliser to nonionic surfactant is less than 1:1, more preferably less than 1:5.

It is beneficial if the solubilising agent/co-solubiliser is present at a level greater than 5 wt % of the total composition, preferably at a level greater than 10 wt %. The solubilising agent/co-solubiliser may be present at a level greater than 20% or even at a level greater than 30% by weight of the composition. Such higher levels are especially preferred where the fabric softening composition is a solid.

Composition pH

The compositions of the invention preferably have a pH of more than 1.5, more preferably less than 5.

Other Ingredients

The composition can also contain fatty acids, for example $C_8$–$C_{24}$ alkyl or alkenyl monocarboxylic acids, or polymeric carboxylic acids. Preferably saturated fatty acids are used, in particular, hardened tallow $C_{16}$–$C_{18}$ fatty acids.

The level of fatty acid material is preferably more than 0.1% by weight, more preferably more than 0.2% by weight. Especially preferred are concentrates comprising from 0.5 to 20% by weight of fatty acid, more preferably 1% to 10% by weight. The weight ratio of fabric softening compound to fatty acid material is preferably from 10:1 to 1:10.

Compositions according to the present invention may contain detergency builders and/or anionic surfactants as desired. However it is especially preferred that the composition is substantially free of builders. It is also preferred that the composition be substantially free of anionic surfactant.

Suitably the composition is substantially free of nonionic hydrophobic organic materials such as hydrocarbons and hydrocarbyl esters of fatty acids.

The composition can also contain one or more optional ingredients, selected from non-aqueous solvents, pH buffering agents, perfumes, perfume carriers, fluorescers, colorants, hydrotropes, antifoaming agents, antiredeposition agents, enzymes, optical brightening agents, opacifiers, polymeric or other thickening agents, anti-shrinking agents, anti-wrinkle agents, anti-spotting agents, germicides, fungicides, anti-oxidants, anti-corrosion agents, drape imparting agents, antistatic agents and ironing aids.

EXAMPLES

The invention will now be illustrated by reference to the following examples. Comparative examples are designated by a letter, while examples of the invention are designated by a number.

Preparation of the Composition

Fabric softening sheets can be coated/impregnated with the composition:

a) by forming a co-melt of the ingredients and coating the sheet or;

b) by forming a solution of the ingredients and coating the sheet, followed by drying the sheet.

Examples 1 and A

Example 1 was prepared according to method b) above. Example 1 had the following formulation:

| | wt/g. |
|---|---|
| HT TMAPC | 48.0 |
| Genapol C100 | 8.0 |
| Plantaren 2000 | 28.0 |

which was coated onto Reemay (spun bonded polyester). Genapol C100=Coco 10 EO ex Hoechst Plantaren 2000= $C_{8-14}$ DP1.4 alkyl polyglucoside ex Henkel HT TMAPC= 1,2 bis[hardened tallowoyloxy]-3 trimethyl ammonium propane chloride ex Hoechst Example A is a commercially available product; its composition is shown below.

Test III described above shows Example 1 transfers fabric conditioner to d. terry towelling but Example A was inferior.

The two examples were subjected to the following test:

A 2 kg load of terry towelling was washed in a Miele W7545 washing machine in the 60° C. main wash cycle. Also included in the load were 4(~813×813 mm) nappy monitors. The washed load was then placed in a Miele tumble dryer with Example 1 or Example A. The load was them tumbled cold for 1 hour. The load was then removed and line dried. The nappy samples were then cut into 190×190 mm squares which were then dyed in bromophenol blue solution.

Composition of bromophenol blue solution: 0.35 g Bromophenol blue+5 g ethanol+1 g demin. water are dissolved together and added to 5 liters of water. Liquid cloth ratio was approximately 25:1.

In this test the cationic active was transferred evenly onto Example 1 compared with Example A which showed poorer transfer.

Softening of the fabrics was assessed after line drying by an expert panel of 4 people using a round robin paired comparison test protocol. Each panel member assessed four sets of test cloths. Each set of test cloths contained one cloth of each test system under a evaluation. Panel members were asked to assess softness on a 8 point scale. Softness scores were calculated using an "Analysis of Variance" technique. Lower values are indicative of better softening.

Examples 2 to 6 and A to D

The following compositions were prepared by Preparation b) described above under Preparation of Compositions.

| | 2 | 3 | 4 | 5 | 6 | 7 |
|---|---|---|---|---|---|---|
| HT TMAPC | | 60 | 60 | 60 | 60 | |
| DEQA | 60 | | | | | 50 |
| Cocolactobionamide | 40 | 40 | 20 | 20 | | |
| Tallow 25E0 | | | | 20 | | |
| *L5351 | | | 20 | | 40 | |
| DDAO | | | | | | 50 |

DEQA = di(tallowyloxyethyl) dimethyl ammonium chloride ex Hoechst
DDAO = N,N-dimethyl dodecylamine-N-oxide ex Fluka
L5351 = fatty acid amide alkyl betaine ex Th Goldschmidt Comparative composition A to D are all commercially available products.

| | A | B | C | D |
|---|---|---|---|---|
| Ditallow dimethyl ammonium methyl sulphate | 70 | 70 | 20.7 | 22.7 |
| Hardened tallow fatty acid | 30 | 30 | | |
| Stearate amine salt | | | 42.9 | 35.9 |
| Sorbitan ester | | | 25.9 | 29.1 |
| Bentonite clay | | | 7.8 | 4.7 |
| Cylcodextrin starch | | | 0 | 4.3 |
| Perfume | | | 3 | 3 |

The compositions were coated onto a polyester sheet 23 cm×23 cm at a variety of coating weights. The sheets were then tested according to Test III above. The transfer of actives from sheets was determined. The coatings applied varied from 0.41 to 3.2 g of active. The softness of the towels was then assessed as described in Example 1. Untreated towels have softness score of 8.

| Sample | Weight of Coating/g | % weight of active transferred | Softness Score |
|---|---|---|---|
| | | 15 minutes | |
| 2 | 1.18 | 67 | 4.0 |
| 3 | 1.04 | 67 | 3.75 |
| 4 | 2.27 | 74 | 4.5 |
| 5 | 0.83 | 52 | 3.75 |
| 6 | 0.77 | 87 | 4.0 |
| 7 | 3.23 | 67 | 3.0 |
| A | 1.53 | 10 | 6.5 |
| B | 2.6 | 4 | 8 |
| C | 2.8 | 3 | 8 |
| D | 1.2 | 13 | 7.75 |
| | | 30 minutes | |
| 2 | 0.85 | 67 | 4.0 |
| 3 | 0.82 | 70 | 3.5 |
| 4 | 1.39 | 60 | 4.0 |
| 5 | 0.67 | 95 | 2.75 |
| 6 | 0.41 | 95 | 3.25 |
| 7 | 1.93 | 90 | 3.25 |
| A | 1.53 | 10 | 6.5 |
| B | 2.6 | 4 | 7.75 |
| C | 2.8 | 3 | 6.75 |
| D | 1.2 | 14 | 7 |

Excellent softness and good active transfer was observed for compositions according to the invention.

The compositions were subjected to Test I described above and filtered through a succession of filters, 1 μm, 0.45 μm and 0.2 μm.

| Sample | % Cationic 0.2 |
|---|---|
| 2 | 80% |
| 3 | 85% |
| 4 | 90% |
| 5 | 88% |
| 6 | 95% |

We claim:

1. A fabric softening composition for coating or impregnating a substrate comprising i) a substantially water insoluble fabric softening compound comprising a cationic head group and two alkyl or alkenyl chains each having an average chain length greater than or equal to or greater than $C_{14}$ or a single alkyl or alkenyl chain with an average chain length greater than or equal to $C_{20}$; and, ii) a solubilizing agent comprising a nonionic or amphoteric surfactant or mixture thereof and optionally a non-surfactant cosolubilizer;

characterized in that the weight ratio of solubilizing agent (ii) to fabric softening (i) compound is greater than 1:6 and when the fabric softening composition is diluted in water to a concentration of 5 wt. % of (i) and (ii), at least 70 wt. % of the fabric softening compound is in solution.

2. A fabric softening composition according to claim 1 in which the water insoluble fabric softening compound comprises a head group and two linear alkyl chains each having an average chain length greater than or equal to $C_{14}$.

3. A fabric softening composition according to claim 1, in which the solubilising agent comprises nonionic or amphoteric surfactant and a non-surfactant co-solubiliser.

4. A fabric softening composition according to claim 1 in which the ratio of solubilising agent to fabric softening compound 2:3 to 4:1.

5. A fabric softening composition according to claim 1 in which the solubilising agent is solid at ambient temperature.

6. A fabric softening composition according to claim 1 in which the solubilising agent is an ethoxylated alcohol containing at least 12 carbon atoms.

7. A fabric softening composition according to claim 1 in which the solubilising agent is a carbohydrate.

8. A fabric softening composition according to claim 1 in which the fabric softening compound has a solubility of less than $1\times10^{-3}$ Wt % in demineralised water at 22° C.

9. A fabric softening composition according to claim 1 in which the fabric softening compound is a quaternary ammonium compound.

10. A fabric softening composition according to claim 8 in which the fabric softening compound is a quaternary ammonium compound having at least one ester link.

11. A fabric softening composition according to claim 8 in which the softening compound is 1,2 bis[hardened tallowoyloxy]-3- trimethylammonium propane chloride.

12. A fabric softening composition according to claim 1 in which the level of solubilising agent is greater than 30 wt % of the total composition.

* * * * *